US007114212B1

(12) United States Patent
Watts

(10) Patent No.: US 7,114,212 B1
(45) Date of Patent: Oct. 3, 2006

(54) BOOT CLEANING DEVICE

(76) Inventor: Richard Watts, 411 Goshen Ave., North Little Rock, AR (US) 72116

( * ) Notice: Subject to any disclaimer, the term of this patent is extended or adjusted under 35 U.S.C. 154(b) by 587 days.

(21) Appl. No.: 10/351,653

(22) Filed: Jan. 28, 2003

(51) Int. Cl.
*A47L 23/02* (2006.01)
*A47L 23/22* (2006.01)
*A46B 11/06* (2006.01)
*A46B 13/02* (2006.01)

(52) U.S. Cl. ..... 15/36; 15/30; 15/34

(58) Field of Classification Search ..... 15/29, 15/30, 34, 36, 69, 4
See application file for complete search history.

(56) References Cited

U.S. PATENT DOCUMENTS 3,638,264 A * 2/1972 Walton ..... 15/4
4,335,481 A * 6/1982 Slayman ..... 15/29
4,370,771 A * 2/1983 Gonzalvo ..... 15/29
4,809,382 A * 3/1989 Ravn ..... 15/29
5,418,996 A 5/1995 Chen
5,839,144 A 11/1998 Willner
5,950,269 A 9/1999 Openshaw et al.
6,584,636 B1 * 7/2003 Schlem ..... 15/104.92
6,634,050 B1 * 10/2003 Barboza ..... 15/29

* cited by examiner

*Primary Examiner*—Gary K. Graham

(57) ABSTRACT

A boot cleaning device includes a base having a bottom surface and a top surface. The top surface has an opening extending therein. A water inlet extends though an outer wall of the base and into a cavity positioned in the based. The water inlet has a coupler extending outwardly from the base. A supply tube has a first end and a second end. The first end is fluidly coupled to the water inlet. The second end extends upwardly through the opening. A water outlet extends into the outer wall of the base and into the cavity. A cleaning assembly is rotatably mounted in the opening. The supply tube extends upwardly through the cleaning assembly.

11 Claims, 2 Drawing Sheets

BOOT CLEANING DEVICE

BACKGROUND OF THE INVENTION

1. Field of the Invention

The present invention relates to footwear cleaning devices and more particularly pertains to a new footwear cleaning device for providing a quick and efficient means for removal of dirt, snow, sand, and mud which may have accumulated on a person's footwear.

2. Description of the Prior Art

The use of footwear cleaning devices is known in the prior art. U.S. Pat. No. 5,950,269 describes a boot and shoe cleaner for cleaning the bottoms and sides of the soles of boots and shoes. Another type of footwear cleaning device is U.S. Pat. No. 5,839,144 describes an automatic boot cleaning apparatus having at least three brushes and a scraper. U.S. Pat. No. 5,418,996 describes a shoe washing machine having a driving means for rotating cleaning discs and a washing means for supplying a cleaning liquid to the shoe.

While these devices fulfill their respective, particular objectives and requirements, the need remains for a device that does not require an electrical source to operate.

SUMMARY OF THE INVENTION

The present invention meets the needs presented above by utilizing water pressure to rotate the cleaning device.

Another object of the present invention is to provide a new footwear cleaning device that would remove debris from footwear that would otherwise be brought into a dwelling where it would stain floors and carpets, causing their premature cleaning or replacement.

Still another object of the present invention is to provide a new footwear cleaning device that would allow a user to clean debris on the soles of shoes in less time, more thoroughly and with less effort than when using a conventional doormat.

To this end, the present invention generally comprise a base having a bottom surface and a top surface. The top surface has an opening extending therein. A water inlet extends though an outer wall of the base and into a cavity positioned in the base. The water inlet has a coupler extending outwardly from the base. A supply tube has a first end and a second end. The first end is fluidly coupled to the water inlet. The second end extends upwardly through the opening. A water outlet extends into the outer wall of the base and into the cavity. A cleaning assembly is rotatably mounted in the opening. The supply tube extends upwardly through the cleaning assembly.

There has thus been outlined, rather broadly, the more important features of the invention in order that the detailed description thereof that follows may be better understood, and in order that the present contributions to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
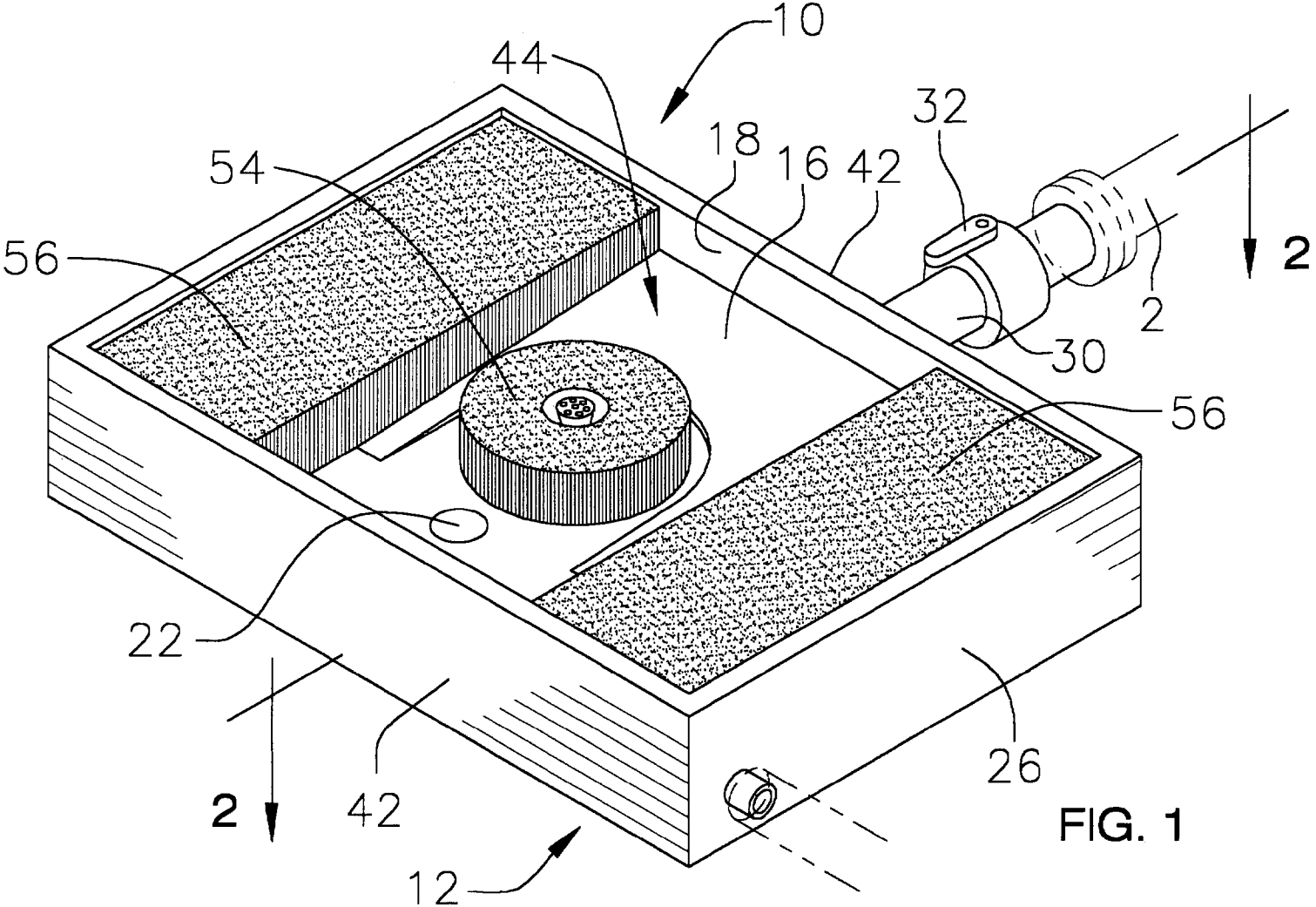
FIG. 1 is a perspective view of a boot cleaning device according to the present invention.

With reference now to the drawings, and in particular of FIGS. 1 through 3 thereof, a new footwear cleaning device embodying the principles and concepts of the present invention and generally designated by the reference numeral 10 will be described.

Figure 2:
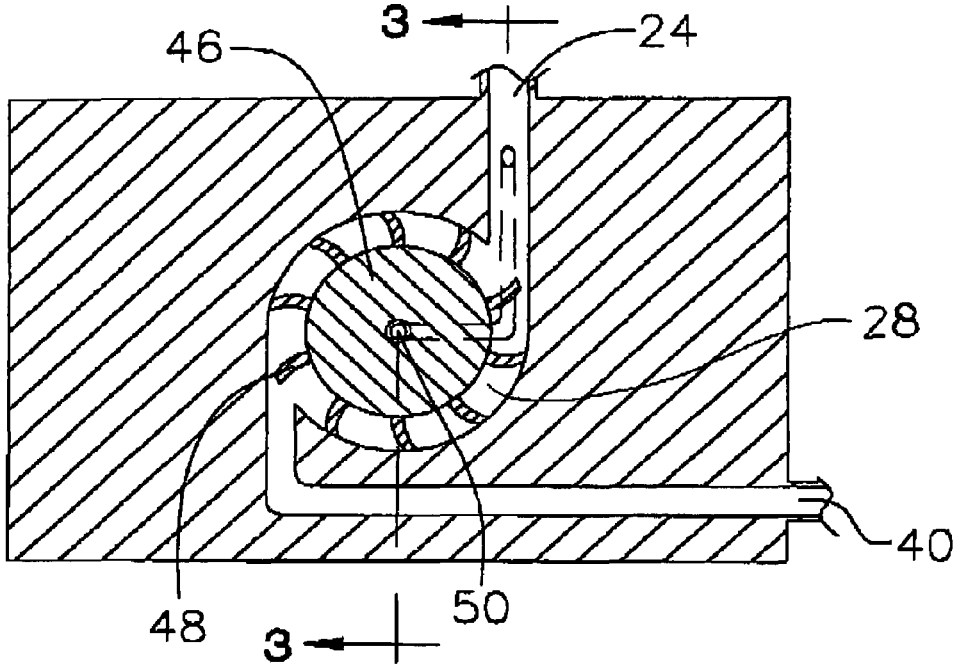
FIG. 2 is a cross-sectional view taken along the line 2—2 of FIG. 1 of the present invention.
Figure 3:
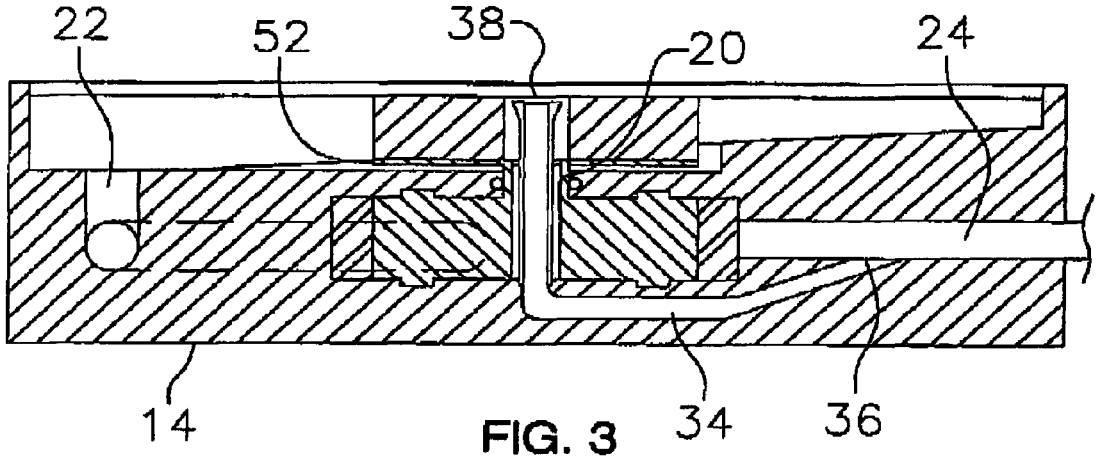
FIG. 3 is a cross-sectional view taken along the line 3—3 of FIG. 2 of the present invention.

As best illustrated in FIGS. 1 through 3, the boot cleaning device 10 generally comprises a base 12 having a bottom surface 14 and a top surface 16. A peripheral wall 18 is attached to and extends upwardly from an edge of the base 12. The top surface 16 has an opening 20 extending therein. The opening 20 is centrally disposed in the top surface 16. A drain hole 22 extends into the top surface 16. The top surface 16 is angled toward the drain hole 22.

A water inlet 24 extends though an outer wall 26 of the base 12 and into a cavity 28 positioned in the base 12. The water inlet 24 has a coupler 30 extending outwardly from the base 12. A valve 32 is positioned in the coupler 30 for selectively opening or closing the water inlet 24. The valve 32 may include a foot-actuated lever, not shown, that is biased in a closed positioned orientated generally parallel to the ground and which extends away from the water inlet 24 at a generally perpendicular angle. This type of foot-actuated lever is opened when it is urged toward the ground so that the user may actuate the valve with their foot. A supply tube 34 has a first end 36 and a second end 38. The first end is fluidly coupled to the water inlet. The second end 38 extends upwardly through the opening 20. A water outlet 40 extends into the outer wall 26 of the base 12 and into the cavity 28. The drain hole 22 extends into the water outlet 40. Preferably the inlet 24 and outlets 40 extend into different side walls 42 of the base 12.

A cleaning assembly 44 is rotatably mounted in the opening 20. The cleaning assembly 44 includes am impeller 46 that is positioned in the cavity 28 and is rotatably mounted on the supply tube 34. The impeller 46 has a plurality of blades 48 attached thereto. Each of the blades 48 has a configuration such that the impeller 46 rotates in a first direction when a fluid enters the inlet 24 and exits through the outlet 40. An axle 50 is attached to the impeller 46 and extends upwardly through the opening 20. A disc 52 is attached to the axle 50. A plurality of bristles 54 is attached to and extends upwardly therefrom. The supply tube 34 extends outwardly through the axle 50 and the disc 52. A portion of water entering the water inlet 24 flows outward of the supply tube 34.

Preferably, a pair of cleaning pads 56 is attached to the top surface 16. The cleaning pads 56 are positioned such that the cleaning pads 56 are positioned on either side of the cleaning assembly 44.

In use, a water supply hose 2 is attached to the coupler 30 and the valve 32 opened so that the impeller 46 is rotated. This in turn rotates the disc 52 and sends water outward through the supply tube 34. A user of the device plates their boot (or shoe) on the disc 52 so that the bristles 54 and water clean any debris off of the boot.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A footwear cleaning apparatus comprising:

a base having a bottom surface and a top surface, said top surface having a opening extending therein, a peripheral wall being attached to and extending upwardly from an edge of said base, a drain hole extending into said top surface, said drain hole extending into a water outlet;

a water extending inlet though an outer wall of said base and into a cavity positioned in said base, said water inlet having a coupler extending outwardly from said base;

a supply tube having a first end and a second end, said first end being fluidly coupled to said water inlet, said second end extending upwardly through said opening;

said water outlet extending into said outer wall of said base and into said cavity; and a cleaning assembly being rotatably mounted in said opening, said supply tube extending upwardly through said cleaning assembly.

2. The footwear cleaning apparatus of claim 1, wherein said top surface is angled toward said drain hole.

3. The footwear cleaning apparatus of claim 1, further including a valve being positioned in said coupler for selectively opening or closing said water inlet.

4. The footwear cleaning apparatus of claim 1, wherein said cleaning assembly includes an impeller being positioned in said cavity and being rotatably mounted on said supply tube, said impeller having a plurality of blades attached thereto, each of said blades having a configuration such that said impeller rotates in a first direction when a fluid enters said inlet and exits through said outlet, an axle being attached to said impeller and extending upwardly through said opening, a disc being attached to said axle, a plurality of bristles being attached to and extending upwardly from said disc, said supply tube extending outwardly through said axle and said disc.

5. The footwear cleaning apparatus of claim 1, further including a pair of cleaning pads being attached to said top surface, said cleaning pads being positioned such that said cleaning pads are positioned on either side of said cleaning assembly.

6. A footwear cleaning apparatus comprising:

a base having a bottom surface and a top surface, a peripheral wall being attached to and extending upwardly from an edge of said base, said top surface having a opening extending therein, said opening being centrally disposed in said top surface, a drain hole extending into said top surface, said top surface being angled toward said drain hole;

a water inlet extending though an outer wall of said base and into a cavity positioned in said base, said water inlet having a coupler extending outwardly from said base, a vale being positioned in said coupler for selectively opening or closing said water inlet;

a supply tube having a first end and a second end, said first end being fluidly coupled to said water inlet, said second end extending upwardly through said opening;

a water outlet extending into said outer wall of said base and into said cavity, said drain hole extending into said water outlet;

a cleaning assembly being rotatably mounted in said opening, said cleaning assembly including;

an impeller being positioned in said cavity and being rotatably mounted on said supply tube, said impeller having a plurality of blades attached thereto, each of said blades having a configuration such that said impeller rotates in a first direction when a fluid enters said inlet and exits through said outlet;

an axle being attached to said impeller and extending upwardly through said opening;

a disc being attached to said axle, a plurality of bristles being attached to and extending upwardly from said disc, said supply tube extending outwardly through said axle and said disc;

wherein a portion of water entering said water inlet flows outward of said supply tube; and a pair of cleaning pads being attached to said top surface, said cleaning pads being positioned such that said cleaning pads are positioned on either side of said cleaning assembly.

7. A footwear cleaning apparatus comprising:

a base having a bottom surface and a top surface, said top surface having a opening extending therein;

a water inlet extending though an outer wall of said base and into a cavity positioned in said base, said water inlet having a coupler extending outwardly from said base;

a supply tube having a first end and a second end, said first end being fluidly coupled to said water inlet, said second end extending upwardly through said opening;

a water outlet extending into said outer wall of said base and into said cavity; and a cleaning assembly being rotatably mounted in said opening, said supply tube extending upwardly through said cleaning assembly, said cleaning assembly including:

an impeller being positioned in said cavity and being rotatably mounted on said supply tube, said impeller having a plurality of blades attached thereto, each of said blades having a configuration such that said impeller rotates in a first direction when a fluid enters said inlet and exits through said outlet;

an axle being attached to said impeller and extending upwardly through said opening, a disc being attached to said axle;

a plurality of bristles being attached to and extending upwardly from said disc, said supply tube extending outwardly through said axle and said disc.

8. The footwear cleaning apparatus of claim 7, wherein said base further includes a peripheral wall being attached to and extending upwardly from an edge of said base, a drain hole extending into said top surface, said drain hole extending into said water outlet.

9. The footwear cleaning apparatus of claim 8, wherein said top surface is angled toward said drain hole.

10. The footwear cleaning apparatus of claim 7, further including a valve being positioned in said coupler for selectively opening or closing said water inlet.

11. The footwear cleaning apparatus of claim 7, further including a pair of cleaning pads being attached to said top surface, said cleaning pads being positioned such that said cleaning pads are positioned on either side of said cleaning assembly.

* * * * *